US005301352A

United States Patent [19]

Nakagawa et al.

[11] Patent Number: 5,301,352

[45] Date of Patent: Apr. 5, 1994

[54] SATELLITE BROADCAST RECEIVING SYSTEM AND CHANGE-OVER DIVIDER FOR USE IN SAME

[75] Inventors: Yutaka Nakagawa; Tadashi Kajiwara, both of Kanagawa; Keiji Fukuzawa, Chiba; Keiji Yuzawa, Tokyo, all of Japan

[73] Assignee: Sony Corporation, Tokyo, Japan

[21] Appl. No.: 904,557

[22] Filed: Jun. 26, 1992

[30] Foreign Application Priority Data

Jul. 4, 1991 [JP] Japan ..... 3-164103

[51] Int. Cl.[5] ..... H04H 1/04

[52] U.S. Cl. ..... 455/3.2; 455/4.2; 455/132; 455/272

[58] Field of Search ..... 455/3.2, 3.1, 4.2, 6.3, 455/272, 133, 136, 140, 188.1, 275, 277.1, 343, 20, 132

[56] References Cited

U.S. PATENT DOCUMENTS

| | | | |
|---|---|---|---|
| 4,509,198 | 4/1985 | Nagatomi . | |
| 4,672,687 | 6/1987 | Horton et al. | 455/3.2 |
| 5,068,918 | 11/1991 | Verheijen et al. | 455/188.1 |
| 5,101,510 | 3/1992 | Duckeck | 455/343 |
| 5,175,878 | 12/1992 | Davis et al. | 455/140 |

FOREIGN PATENT DOCUMENTS

| | | | |
|---|---|---|---|
| 0058519 | 3/1991 | Japan | 455/3.2 |
| 0240322 | 10/1991 | Japan | 455/3.2 |
| 0240323 | 10/1991 | Japan | 455/3.2 |
| 2178274 | 2/1987 | United Kingdom . | |

OTHER PUBLICATIONS

PCT Published Application WO 91/00646 (Mutzig et al.), published Jan. 10, 1991.

Patent Abstracts of Japan, vol. 15, No. 209, May 28, 1991, Publication No. JP3058521.

Patent Abstracts of Japan, vol. 11, No. 145, Published May 12, 1987, Publication No. JP61281778 (Minazau).

Patent Abstracts of Japan, vol. 14, No. 26, Published Apr. 18, 1988, Publication No. JP1265688 (Noda).

*Primary Examiner*—Reinhard J. Eisenzopf

*Assistant Examiner*—Nguyen Vo

*Attorney, Agent, or Firm*—Lewis H. Eslinger; Jay H. Maioli

[57] ABSTRACT

A satellite broadcast receiving system in which, when each receiver transmits a control pulse to a change-over divider via a signal cable, the change-over divider selects a desired broadcast signal in response to the control pulse, which is led to its output terminal, then transmitted to each receiver via the signal cable.

3 Claims, 3 Drawing Sheets

SATELLITE BROADCAST RECEIVING SYSTEM AND CHANGE-OVER DIVIDER FOR USE IN SAME

BACKGROUND OF THE INVENTION

The present invention relates to a satellite broadcast receiving system and a change-over divider for use in this system.

In the near future, satellite broadcasts may include Communication Satellite (CS) broadcast using a communication satellite in addition to Broadcast Satellite (BS) broadcast. Further, CS broadcast may be performed by a plurality of communication satellites. Due to the fact that the height and position of the broadcast satellites and communication satellites are different from each other, a receiver cannot catch all radio waves transmitted therefrom by a single satellite antenna, and thus it should be provided with a plurality of satellite antennas. Additionally, due to overlap of the transmission frequency band of a signal for each broadcast, a single signal cable is not sufficient to transmit signals at the same time.

Accordingly, when dividing broadcast signals among a plurality of receivers by using a plurality of common satellite antennas, signal cables corresponding to the number of signals are needed to connect a change-over divider to each receiver, resulting in extremely complicated connection. Further, some people cannot utilize a plurality of signal cables, as limited by their domestic conditions.

It is, therefore, an object of the present invention to provide a satellite broadcast receiving system and a change-over divider for use in this system which contribute to a simplification of the architecture and a reduction in manufacturing cost.

SUMMARY OF THE INVENTION

According to one aspect of the present invention, there is provided a system for receiving broadcast and communication signals, comprising:

a plurality of antennas disposed to receive the broadcast and communication signals;

a change-over divider connected to said plurality of antennas and having a plurality of output terminals, said change-over divider separately outputting a predetermined one of the broadcast and communication signals to said plurality of output terminals, respectively; and a plurality of receivers connected to said plurality of output terminals of said change-over divider, said plurality of receivers providing a control pulse to said change-over divider for selecting one of said plurality of antennas, respectively.

According to another aspect of the present invention, there is provided a change-over divider for selecting signals, comprising:

a plurality of input terminals;

a plurality of switches connected to said plurality of input terminals;

a plurality of output terminals connected to outputs of said plurality of switches;

control pulse detection circuit means connected to said plurality of output terminals for detecting a control pulse; and a microcomputer connected to said plurality of switches and said control pulse detection circuit means, said microcomputer decoding said control pulse, said microcomputer outputting a change-over control signal to said plurality of switches in response to said control pulse as decoded, said plurality of switches selecting a predetermined one of the signals in response to said change-over control signal of said microcomputer.

DETAILED DESCRIPTION OF THE INVENTION

Figure 1:
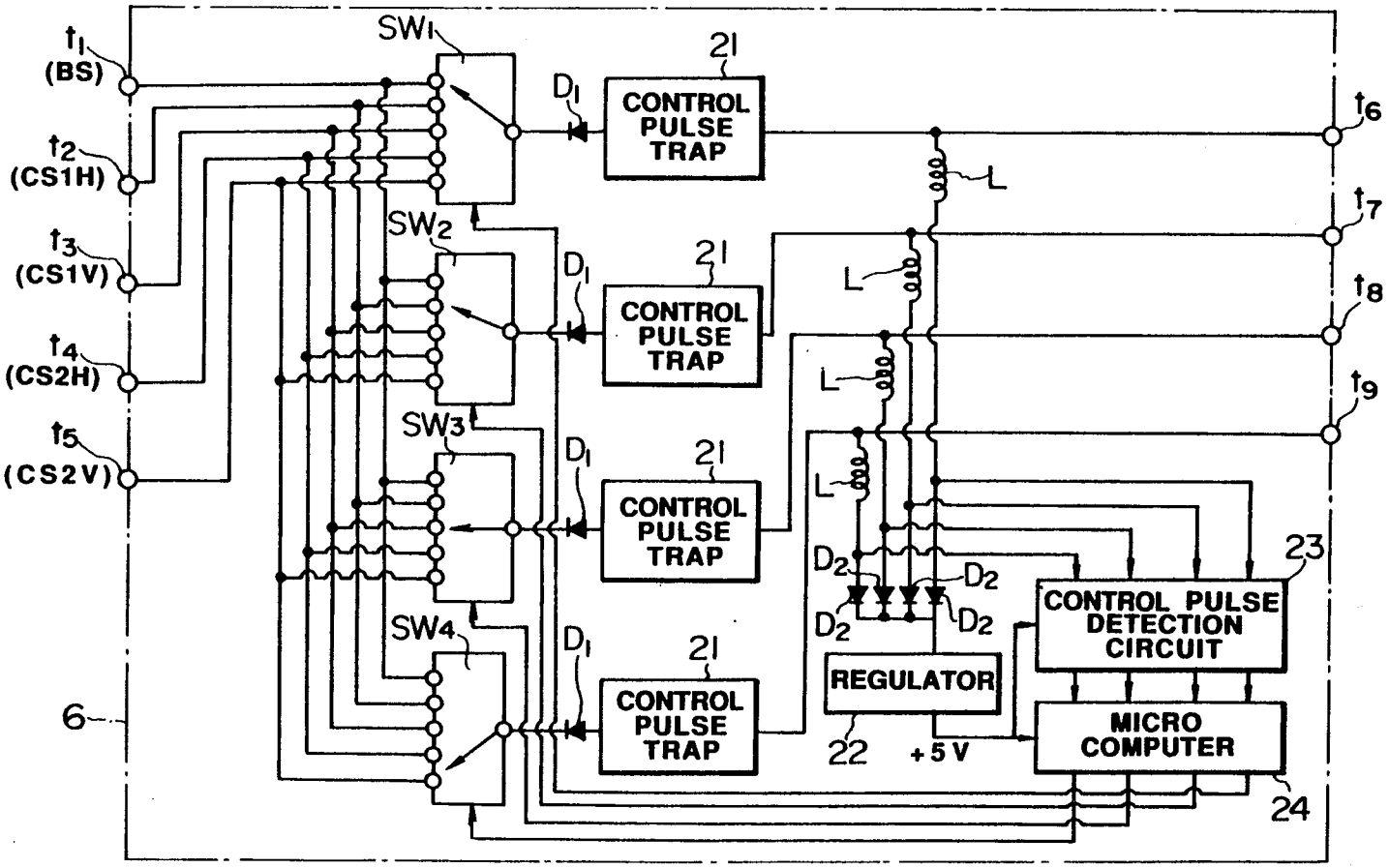
FIG. 1 is a circuit block diagram showing a change-over divider (first preferred embodiment)

Referring to the drawings, wherein like reference numerals designate corresponding parts throughout the views, referring first to FIGS. 1 and 2, a first preferred embodiment of the present invention will be described. FIG. 2 shows a circuit block diagram of a satellite broadcast receiving system. Three antennas are disposed as satellite antenna: BS antennas 1, $CS_1$ antenna 2, and $CS_2$ antenna 3. The BS antenna 1 serves to collect BS broadcast wave, and the $CS_1$ antenna 2 serves to collect $CS_1$ broadcast wave, and the $CS_2$ antenna 3 serves to collect $CS_2$ broadcast wave.

BS broadcast wave as collected by the BS antenna 1 is a circularly polarized wave, and it is received in a BS converter 4. A single BS broadcast signal is converted in the BS converter 4 to have a predetermined frequency, then led to a first input terminal $t_1$ of a change-over divider 6 via a signal cable 5.

$CS_1$ broadcast wave as collected by the $CS_1$ antenna 2 is composed of two linearly polarized waves which meet at right angles, and it is received in a $CS_1$ converter 7. A horizontally polarized broadcast signal and a vertically polarized broadcast signal are converted in the $CS_1$ converter 7 to have a predetermined frequency, respectively, then led to second and third input terminals $t_2$, $t_3$ of the change-over divider 6 via two signal cables 8, 9, respectively.

$CS_2$ broadcast wave as collected by the $CS_2$ antenna 3 is composed of two linearly polarized waves like the $CS_1$ broadcast wave, and it is received in a $CS_2$ converter 10. A horizontally polarized broadcast signal and a vertically polarized broadcast signal are converted in the $CS_2$ converter 10 to have a predetermined frequency, respectively, then led to fourth and fifth input terminals $t_4$, $t_5$ of the change-over divider 6 via two signal cables 11, 12, respectively.

The change-over divider 6 has four output terminals $t_6$–$t_9$, and separately selects a desired one of the five input broadcast signals as an output. A detailed architecture thereof is shown in FIG. 1. The output terminals $t_6$–$t_9$ are connected to signal cables 13–16 at ends thereof, respectively. The signal cables 13–16 have the other ends connected to BS/CS receivers 17–20, respectively.

The BS/CS receivers 17–20 are constructed to output converter power supply (DC power voltage) via the signal cables 13–16 when turned on by a power switch. Additionally, the BS/CS receivers 17–20 each have a broadcast selecting switch, which permits selection of five kinds of broadcast such as BS broadcast, $CS_1$ horizontally polarized wave broadcast, etc. Information selected by the broadcast selecting switch is converted into a control pulse in a pulse code circuit, which is output together with the converter power supply via each of the signal cables 13–16.

Figure 2:
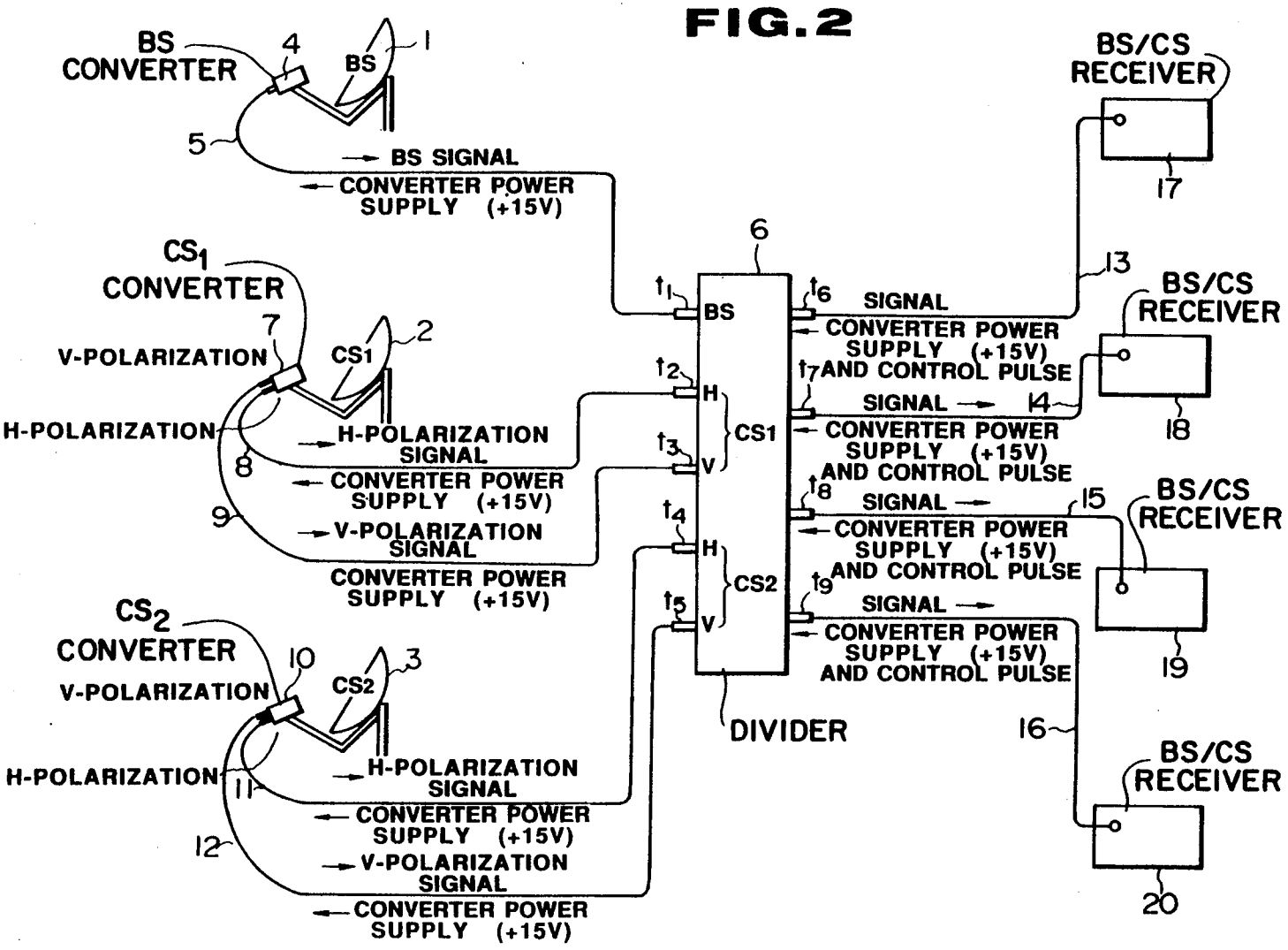
FIG. 2 is a view similar to FIG. 1, showing a satellite broadcast receiving system (first preferred embodiment)

FIG. 1 shows a circuit block diagram of the change-over divider 6. The change-over divider 6 is provided with first to fourth change-over switches $SW_1$–$SW_4$ corresponding to the number of the output terminals $t_6$–$t_9$, each receiving all the five input broadcast signals. The change-over switches $SW_1$–$SW_4$ select one of the five broadcast signals in response to the change-over control signal, respectively. This broadcast signal as selected is provided to the output terminals $t_6$–$t_9$ via a diode $D_1$ and a control pulse trap circuit 21.

The output terminals $t_6$–$t_9$ are connected via a coil L and a diode $D_2$ to a regulator 22, respectively, which provides constant voltage to a control pulse detection circuit 23 and a microcomputer 24. Additionally, the output terminals $t_6$–$t_9$ are connected via the coil L to the control pulse detection circuit 23, respectively, which detects the control pulse as transmitted to output the control pulse to the microcomputer 24.

The microcomputer 24 decodes the control pulse, and outputs the change-over control signal to the first to fourth change-over switches $SW_1$–$SW_4$ corresponding to the output terminals $t_6$–$t_9$ to which selected information is input in accordance with this selected information as decoded.

Next, the operation of this embodiment will be described. One of the four BS/CS receivers 17–20, for example, the BS/CS receiver 17, is turned on by the power switch, and selects BS broadcast by the broadcast selecting switch. Then, converter power supply is output via the signal cable 13 while a control pulse is output together with this. Since the control pulse is a digital signal, it is hardly affected by voltage fluctuation, resulting in sure transmission.

The regulator 22 receives the converter power supply, and provides power supply to the control pulse detection circuit 23 and the microcomputer 24. The microcomputer 24 receives the control pulse from the control pulse detection circuit 23, and it decodes this control pulse and outputs the change-over control signal to the first change-over switch $SW_1$.

The first change-over switch $SW_1$ selects a BS broadcast terminal. Converter power supply is provided from the first change-over switch $SW_1$ to the BS converter 4 via the signal cable 5. By this, the BS converter 4 is driven to output BS broadcast signal. This BS broadcast signal is led to the change-over divider 6 via the signal cable 5 so as to reach the first output terminal $t_6$ via the first change-over switch $SW_1$. Then, it is output to the BS/CS receiver 17 via the signal cable 13.

In this situation, when the other BS/CS receivers 18–20 are also turned on and select a desired broadcast signal, respectively, the second to fourth change-over switches $SW_2$–$SW_4$ select a desired broadcast signal terminal, respectively. Converter power supply is provided to the $CS_1$ converter 7 and $CS_2$ converter 10 as selected, which are thus driven to output desired broadcast signals to the BS/CS receivers 18–20. Accordingly, disposing a single signal cable 13–16 to connect each of the BS/CS receivers 17–20 to the change-over divider 6 is sufficient to separately receive a desired broadcast.

Figure 3:
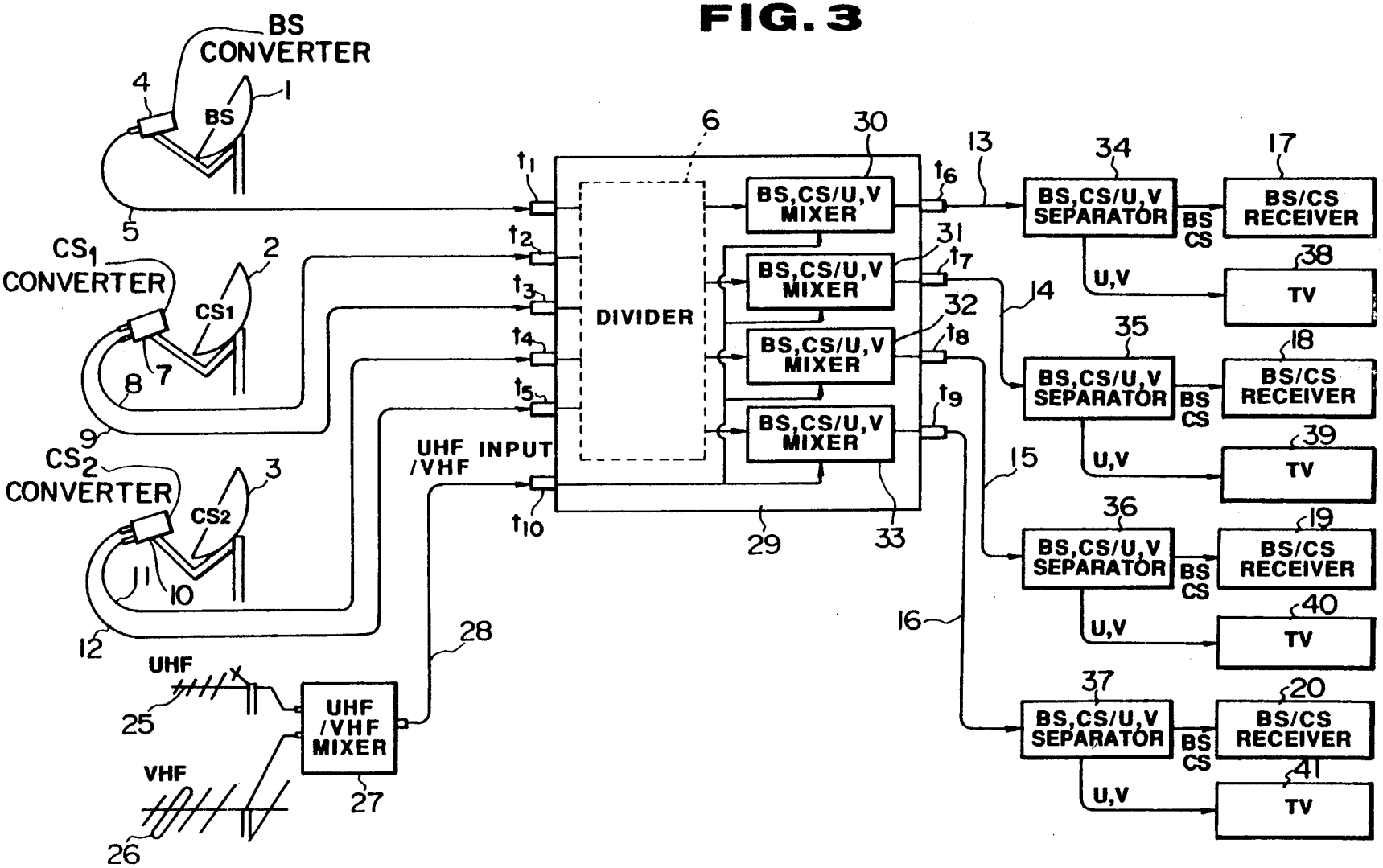
FIG. 3 is a view similar to FIG. 2, showing a broadcast receiving system (second preferred embodiment).

Referring to FIG. 3, a second preferred embodiment of the present invention will be described. The second preferred embodiment is constructed to be a system capable of receiving Ultra High Frequency (UHF) broadcast and Very High Frequency (VHF) in addition to satellite broadcast. FIG. 3 shows a circuit block diagram of a broadcast receiving system.

Outputs of a UHF antenna 25 and a VHF antenna 26 are input to a UHF/VHF mixer 27 in which a UHF broadcast signal and a VHF broadcast signal are mixed together. Output of the UHF/VHF mixer 27 is led to a sixth input terminal $t_{10}$ of a U.V mixer/change-over divider 29 via a signal cable 28.

The U.V mixer/change-over divider 29 has first to fifth input terminals $t_1$–$t_5$ to which the same broadcast signals as the first preferred embodiment are input, and to which the change-over divider 6 having the same architecture as the first preferred embodiment is connected. Outputs of the change-over divider 6 are input to the BS.CS/U.V mixers 30–33, respectively, to which the sixth input terminal $t_{10}$ is also connected, and in which satellite wave and ground wave are mixed together. Outputs of the mixers 30–33 are led to the first to fourth output terminals $t_6$–$t_9$, respectively.

The output terminals $t_6$–$t_9$ are connected to the signal cables 13–16 at one ends thereof, respectively. The signal cables 13–16 have the other ends connected to BS.CS/U.V separators 34–37, respectively. The separators 34–37 serve to separate satellite wave and ground wave, and output satellite wave to the BS/CS receivers 17–20 and ground wave to televisions (TVs) 38–41, respectively.

In this second preferred embodiment, the BS/CS receivers 17–20 can separately receive not only satellite broadcasts, but TVs 38–41 can receive UHF and VHF broadcasts.

In the above embodiments, the number of the output terminals $t_6$–$t_9$ is four, but it is not limited thereto and may be another.

What is claimed is:

1. A system for receiving broadcast satellite signals and communication satellite signals, comprising:

a plurality of antennas disposed to receive said broadcast satellite and communications satellite signals;

a plurality of converters mounted respectively on said plurality of antennas for respectively converting a frequency of said received broadcast satellite and communication satellite signals into a respective predetermined frequency;

a change-over divider connected to said plurality of converters and having a plurality of output terminals, said change-over divider separately outputting a predetermined one of the frequency converted broadcast satellite and communication signals from said plurality of converters to said plurality of output terminals, respectively and a plurality of receivers connected to said plurality of output terminals of said change-over divider, said plurality of receivers providing a control pulse fed to said change-over divider for selecting one of said plurality of converters, respectively, said control pulse being combined with a converter power supply voltage supplied by said plurality of receivers to said plurality of converters through said change-over divider and a plurality of cables for connecting said plurality of output terminals of said change-over divider to said plurality of said receivers, respectively, and said control pulse, said converter power supply voltage and said predetermined one of the frequency converted broadcast satellite and communication signals transmitted over a single one of said plurality of cables.

2. A system as claimed in claim 1, wherein said converter power supply voltage supplied by said plurality of receivers comprises a DC power voltage fed to said plurality of converters, respectively.

3. A system as claimed in claim 1, further comprising:

antenna means disposed to receive UHF and VHF broadcast signals and produce non-converted output signals supplied to said change-over divider;

said change-over divider including means for providing said non-converted output signals at least one of said plurality of output terminals; and receiver means connected to said at least one of said plurality of output terminals of said change-over divider, said receiver means receiving said non-converted output signals from said antenna means for display thereof.

* * * * *